US008066949B2

(12) United States Patent
McKnight et al.

(10) Patent No.: US 8,066,949 B2
(45) Date of Patent: Nov. 29, 2011

(54) SCRUBBER FOR FLUID COKER UNIT

(75) Inventors: Craig A. McKnight, Sherwood Park (CA); Larry P. Hackman, St. Albert (CA); Brian A. Knapper, Edmonton (CA); Daniel Bulbuc, Fort McMurray (CA); George B. Jones, Calgary (CA); Jonathan Tyler, Vancouver (CA); Darwin E. Kiel, New Westminster (CA)

(73) Assignee: ExxonMobil Research & Engineering Company, Annandale, NJ (US)

( * ) Notice: Subject to any disclaimer, the term of this patent is extended or adjusted under 35 U.S.C. 154(b) by 313 days.

(21) Appl. No.: 12/232,947

(22) Filed: Sep. 26, 2008

(65) Prior Publication Data

US 2010/0078305 A1 Apr. 1, 2010

(51) Int. Cl.
*C10G 9/32* (2006.01)

(52) U.S. Cl. ..... 422/140; 96/366; 196/136; 196/140; 261/109; 422/147

(58) Field of Classification Search ..... 422/140, 422/147; 96/301, 321, 366; 261/109, 113; 196/111, 125, 136, 138, 140; 208/48 Q, 208/100, 101; 55/344, 141, 146, 462; 202/84, 202/185.2

See application file for complete search history.

(56) References Cited

U.S. PATENT DOCUMENTS

| | | | | |
|---|---|---|---|---|
| 1,793,885 | A | 2/1931 | Watson et al. | |
| 2,895,896 | A | 12/1954 | Vander Ploeg | |
| 2,859,168 | A * | 11/1958 | Downing et al. | 208/48 R |
| 2,873,247 | A | 2/1959 | Borey | |
| 2,889,265 | A | 6/1959 | Borey et al. | |
| 2,890,999 | A | 6/1959 | Polack | |
| 2,911,355 | A | 11/1959 | Ernst, Jr. | |
| 2,946,741 | A | 7/1960 | Miller | |
| 3,481,834 | A | 12/1969 | Squires | |
| 3,707,462 | A | 12/1972 | Moss | |
| 4,220,518 | A | 9/1980 | Uchida et al. | |
| 4,339,399 | A * | 7/1982 | Nutter | 261/112.1 |
| 4,714,109 | A | 12/1987 | Tsao | |

(Continued)

FOREIGN PATENT DOCUMENTS

DE 1009744 6/1957

(Continued)

OTHER PUBLICATIONS

Hobson G. D., "Modern Petroleum Technology", (ed.) 4th Edition, Applied Science Publ. Ltd., Barking. 1973, ISBN 085334 487 6.

(Continued)

*Primary Examiner* — Jill Warden
*Assistant Examiner* — Joye L Woodard
(74) *Attorney, Agent, or Firm* — Malcolm D. Keen; Glenn T. Barrett

(57) ABSTRACT

Fouling in the scrubber section of a fluid coker unit is reduced by providing perforated baffles to improve the uniformity of the gas flow profile in the scrubber by reducing the gas velocity of the cyclone outlet gases in the scrubber section of the unit. These baffles are located with the objective of reducing the rotational component of the gas flow in the scrubber created by the alignment of the gas outlets of the cyclones. The baffles are preferably located in the shed section of the scrubber and comprise upstanding perforated plates located at the periphery of the scrubber section to disrupt high velocity gas jets in the region of the interior wall of the scrubber.

12 Claims, 3 Drawing Sheets

U.S. PATENT DOCUMENTS

| | | | | |
|---|---|---|---|---|
| 5,076,910 | A | 12/1991 | Rush | |
| 5,632,933 | A * | 5/1997 | Yeoman et al. | 261/109 |
| 6,889,961 | B2 | 5/2005 | Laird et al. | |
| 7,416,575 | B2 * | 8/2008 | Oh et al. | 55/416 |
| 2003/0044332 | A1 | 3/2003 | Conrad et al. | |
| 2004/0020278 | A1 | 2/2004 | McGarvey et al. | |

FOREIGN PATENT DOCUMENTS

| | | |
|---|---|---|
| FR | 1105019 | 11/1955 |
| GB | 452500 | 8/1936 |
| GB | 692325 | 6/1953 |
| GB | 723149 | 2/1955 |
| GB | 764203 | 12/1956 |
| GB | 840104 | 7/1960 |
| GB | 1267467 | 3/1972 |
| WO | WO9933557 | 7/1999 |
| WO | WO2006028752 | 3/2006 |

OTHER PUBLICATIONS

Kister H. Z., and Schwartz S., "Olefin producer uses shed decks to improve quench tower operations", Oil & Journal, May 20, 2002, pp. 50-58, vol. 100, Issue 20.

* cited by examiner

SCRUBBER FOR FLUID COKER UNIT

FIELD OF THE INVENTION

The invention relates to fluidized bed coking, a thermal cracking process used in the refining of heavy petroleum oils to produce lower molecular weight, lower boiling range products.

BACKGROUND OF THE INVENTION

Fluidized bed coking (fluid coking), including its variant, the Flexicoking™ process, is a pyrolysis process used in the petroleum refining industry in which heavy petroleum fractions, typically the non-distillable residue (resid) from vacuum fractionation, are converted to lighter, more useful products by pyrolysis (coking) at elevated reaction temperatures, typically about 500 to 600° C. (approximately 900 to 1100° F.). In fluid coking, the heated heavy oil feed, mixed with atomizing steam, is admitted through a number of feed nozzles to a large vessel containing coke particles fluidized with steam and maintained at a temperature high enough to carry out the desired cracking reactions in the reactor section of the vessel. The feed components not immediately vaporized coat the coke particles and are subsequently decomposed into layers of solid coke and lighter products which evolve as gas or vaporized liquids which mix with the fluidizing steam and pass upwardly through the dense fluidized bed of coke particles, through a phase transition zone into a dilute phase zone above. The solid coke consists mainly of carbon with lesser amounts of hydrogen, sulfur, nitrogen, and traces of vanadium, nickel, iron, and other elements derived from the feed material. The fluidized coke is continuously withdrawn from the reactor vessel, steam-stripped and circulated through a burner, where part of the coke is burned with air to raise its temperature from about 500 to about 700° C. (about 900 to 1300° F.), after which it is returned to the reactor vessel to provide heat for the coking reaction.

The mixture of vaporized hydrocarbon products and steam continues to flow upwardly through the dilute phase at superficial velocities of about 1 to 2 metres per second (about 3 to 6 feet per second), entraining some fine solid coke particles. The gases then pass upwards out of the reactor section of the vessel through separator cyclones into a scrubber section. Most of the entrained solids are separated from the gas phase by centrifugal force in the cyclones and are returned through the cyclone diplegs to the dense fluidized bed by gravity. The mixture of steam and hydrocarbon vapor is discharged from the cyclone outlet and quenched to about 370-400° C. (about 700-750° F.) by contact with circulating oil in the scrubber section of the fluid coker vessel. The scrubber is equipped with internal sheds normally in the form of inverted U- or V-shaped elements, to facilitate contact between the ascending vapors and the oil passing down from a distributor above the sheds. The contact between the high boiling circulating oil and the ascending vapors provides cooling of the hot vapors and promotes condensation of the heaviest fraction of the vaporized product. A de-entrainment section is also conventionally provided above the sheds with additional wash oil provided from a distributor located above the de-entrainment device. The de-entrainment device acts to remove entrained heavy oil droplets from the vapors and to cool the vapors further; it is important to the quality of the final coker gas oil product that the de-entrainment device should not accumulate coke particles and other impurities which can be entrained by the passing vapors. Heavy oil and solids and liquids separated in the scrubber section pass out at the bottom of the scrubber section to a pumparound loop which circulates condensed liquid to an external cooler and back to the top of the sheds in the scrubber section. This heavy fraction is typically recycled to extinction by feeding back to the fluidized bed reaction zone, but may be present for several hours in the pool at the bottom of the scrubber section.

Fluid coking is an established process and is described briefly, for example, in *Modern Petroleum Technology*, Hobson, G. D. (Ed.), 4$^{th}$ Edition, Applied Science Publ. Ltd., Barking, 1973, ISBN 085334 487 6.

The gas phase undergoes a pressure drop and cooling as it passes through the cyclones, primarily at the inlet and outlet passages where gas velocity increases. The cooling which accompanies the pressure decrease causes condensation of some liquid which deposits on surfaces of the cyclone inlet and outlet. Because the temperature of the liquid so condensed and deposited is higher than about 500° C. (about 900° F.), coking reactions occur there, leaving solid deposits of coke. Coke deposits also form on the scrubber sheds, the de-entrainment device and other surfaces. In particular, fouling of the de-entrainment device, normally a grid, restricts the open flow paths in the grid and eventually leads to flooding and black oil entrainment. A poorly operating scrubber can readily lead to poor product quality since this is determined in part by scrubber operation: heavy ends which contain metals, Conradson Carbon Residue (CCR) and, in the case of tar sand operations, fine clay solids, can enter the coker products, leading to problems in downstream units, particularly catalytic units such as hydrotreaters in which metals such as vanadium and nickel can poison the catalyst and entrained clay solids plug catalyst beds and cause high pressure drop.

One pathway by which fouling of the scrubber sheds and of the de-entrainment device is believed to arise is coking of heavy oil entrained in the scrubber section by the high velocity gas flow from the cyclone outlets. The heavy components in the oil carried up from the sheds impact the de-entrainment device and then become coked as a result of high temperatures prevailing in the scrubber. At the end of a run, this fouling can be so bad that the de-entrainment device loses its effectiveness as a contact device: it floods, and allows heavy components from the circulating oil into the product stream. This problem, moreover, becomes more severe as the degree of fouling increases and the gas flow passages become progressively smaller, the gas flow in the de-entrainment device then becomes correspondingly faster and entrainment into the product from the unit sent to downstream units, in turn, increases yet further.

SUMMARY OF THE INVENTION

We have now found that the rate of fouling in the scrubber section of a fluid coker unit may be reduced by providing baffles to reduce the local gas velocity of the cyclone outlet gases in the scrubber section of the unit. If the velocity of the gas jets from the cyclone outlets is reduced, entrainment of the circulating oil is reduced as the gas flow becomes more even and the temperature is reduced by improved contact between the hot gas jets and the cool circulating oil passing over the sheds. These baffles may be located either in or below the shed section of the scrubber, the objective in either case, being to reduce the local gas velocity in the scrubber, mainly in the shed section where the majority of the entrainment to the de-entrainment device takes place. By reducing the extent to which the hot gases from the cyclones bypass the sheds, two benefits result, fouling of the de-entrainment device is reduced and entrainment of circulating oil from the sheds into the product stream is reduced. Reducing the entrainment of the circulating oil also has an additional benefit: as the efficiency of the de-entrainment device is improved, the amount of material it needs in order to work is reduced and, as a result, lower levels of heavy oil contaminants may be achieved in the product.

According to the present invention, therefore, the fluid coking unit comprises a reactor section, a superimposed scrubber section, at least one separator cyclone having its gas outlet communicating with the scrubber section and directing gas flow from the cyclone outlet in a rotational direction about the central axis of the scrubber section, and a shed section above the gas outlet of the cyclone, baffles are located above the cyclone gas outlets to improve the uniformity of the gas flow profile in the scrubber by reducing the velocity of the gases from the cyclone gas outlet in the region of the scrubber wall.

According to a preferred embodiment of the invention, the baffles located in the shed section of the scrubber comprise upstanding perforated plates located at the periphery of the scrubber section to reduce the gas velocity in the region of the interior wall of the scrubber and produce a more uniform gas flow through the shed section.

DRAWINGS

DETAILED DESCRIPTION

The present invention is applicable to fluid coking units, that is, to petroleum refinery process units in which a heavy oil feed is thermally cracked in the presence of a fluidized bed of coke particles which supply the heat required for the endothermic cracking reactions. Coke particles are continuously withdrawn from the bed and partly combusted in a separate coke burner vessel to raise the temperature of the particles which are then recirculated to the reactor vessel, as described above. Coke is also withdrawn from the unit as a fuel coke product or, alternatively, may be sent to a gasifier to be converted into refinery fuel gas, as in a Flexicoker fluid coking unit, as licensed by ExxonMobil Research and Engineering Company.

Figure 1:
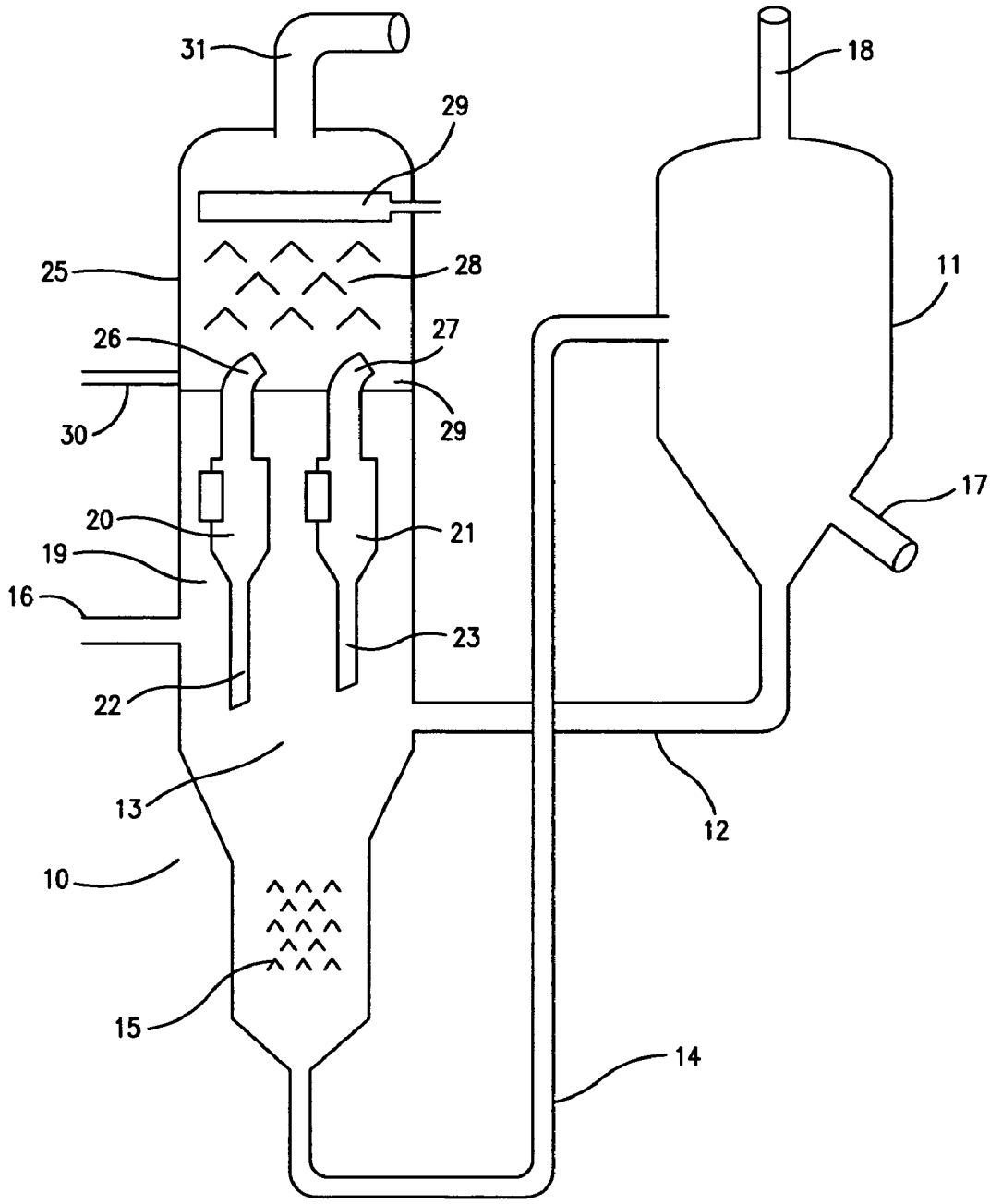
FIG. 1 is a simplified cross-sectional diagram of a fluid coking unit.

FIG. 1 shows a fluid coking unit with a reactor vessel 10 and a burner vessel 11 connected in the conventional manner by coke withdrawal conduit 14 which takes coke particles from the fluidized bed at location 13 in reactor 10 to burner vessel 11 by way of a steam stripper 15. Recirculating conduit 12 returns heated coke particles from burner vessel 11 to reactor 10 to supply heat to the fluidized bed. Coke may be withdrawn from burner vessel 11 through outlet 17 either to pass to the gasifier of a Flexicoker unit or as coke product. Combustion gases pass out through stack 18.

The reactor vessel comprises a large, cylindrical vessel with its axis vertical; typical units have reactors from about 4 to 12 m. in diameter and up to about 30 m. high. Heavy oil feed with additional steam is introduced into the vessel in the region 13 of the fluidized bed, only one inlet 16 being shown for clarity although in the actual unit, multiple inlets arranged around the reactor vessel may be provided to ensure bed uniformity. As described above, the thermal cracking (coking) reactions take place in fluidized bed located at 13 and the products from the bed pass up into the separator cyclones, two of which are indicated at 20 and 21. Solid coke particles separated in the cyclones are returned to the fluid bed through cyclone diplegs 22, 23 and the vapor/liquid products pass into scrubber section 25 of the vessel superimposed above reaction section 19. The gas outlets 26, 27 of cyclones 20, 21 exhaust into the lower portion of the scrubber section through the outlet snouts of the cyclones. Typically, one to six or more cyclones will be provided depending on the size of the unit.

A number of sheds typically in the form of inverted U-shaped or inverted V-shaped sections is arranged above the cyclone gas outlets, with one indicated by 28. A distributor 29 located above stripper sheds 28 is fed with circulating oil as described above to cool the ascending vapors and to remove at least some liquid from the products passing out from the unit through outlet 31 to the product fractionation and recovery section (not shown). Conventionally, a de-entrainment section with its own wash oil distributor is located above the sheds but is omitted from the drawing for simplicity. Material washed down from the de-entrainment device is allowed to pass down over the sheds to be picked up from the scrubber pool 29 with the circulating heavy oil stream to be withdrawn through line 30.

Figure 2:
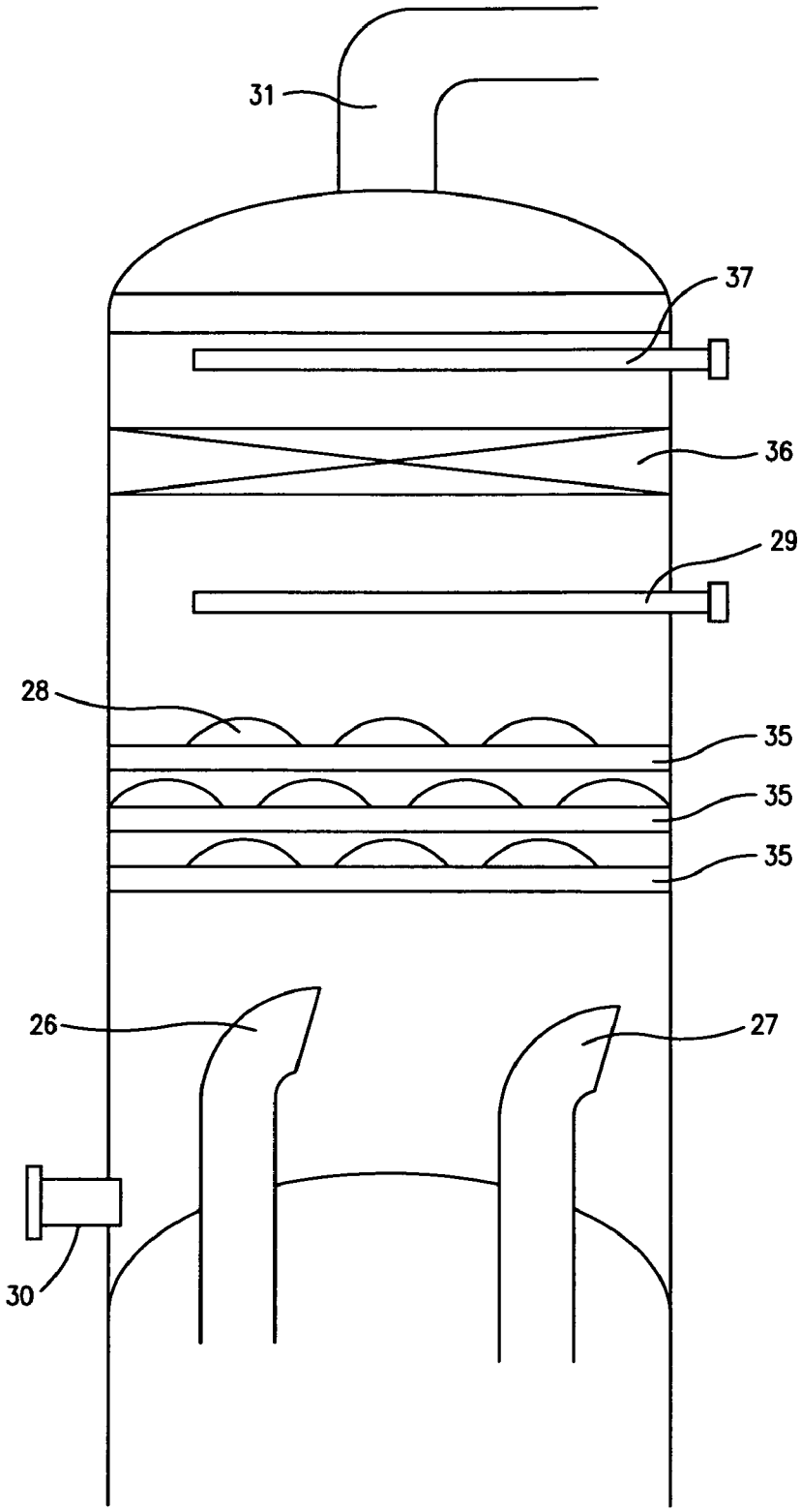
FIG. 2 is a partial sectional view of the scrubber section of a fluid coker scrubber with a de-entrainment grid above the shed section.

FIG. 2 shows the scrubber section in greater detail with the like parts numbered as in FIG. 1. The cyclone snouts 26, 27 protrude up from the reactor section into the scrubber section 25. The gas outlets of the cyclones are conventionally directed tangentially relative to the scrubber wall to provide access for on-stream cleaning with suitable tools. Because the outlets are directed in the same direction to avoid direct impact of the gas stream with the scrubber internals and mutual interference of the discharge jets, a rotating flow pattern is induced in the gas flow in the scrubber section. The scrubber sheds 28 (one indicated) are supported by means of transverse support beams 35 which run from wall to wall of the vessel. under the sheds. The sheds 28 are arranged in vertically-spaced levels with at least five levels of sheds will be provided in most cases; from five to ten levels are typical. The shed distributor 29 is located above the shed section with its connection to the circulating oil feed provided from outside the vessel. De-entrainment grid 36 is positioned above the sheds with its own wash oil distributor 37 again fed from outside the vessel by a pumparound wash oil circuit from the downstream fractionator.

The rotating motion imparted to the gases from the cyclones assists in separating liquids from the vapor products of cracking but as noted above, it also tends to entrain liquid from the sheds and carry it up into the de-entrainment device where it undergoes coking reactions and causes fouling. Also, the gas flow may carry coke particles in the gas from the cyclones and carry it up into the device along with entrained oil. The entrained liquids then tend to accumulate on the internals of the scrubber section and, as a result of the high temperatures prevailing there, undergo coking reactions which form coke fouling deposits on the internals, especially the scrubber sheds and the de-entrainment device. Entrainment of the circulating oil and the consequent tendency to foul the de-entrainment device tends to increase with increasing gas velocity in the scrubber section. Fouling, in turn, tends to increase gas velocity as the size of the flow passages in the de-entrainment section decreases and so, the fouling tendency is a self-feeding negative loop phenomenon.

According to the present invention, the gas flow pattern in the scrubber section is rendered more uniform by the use of upstanding, generally vertical baffles under or in the shed section of the scrubber. The baffles are preferably located towards the periphery of the scrubber section where the rotational component of gas velocity is greatest. The central, axial section of the scrubber is preferably left free of baffles.

Figure 3:
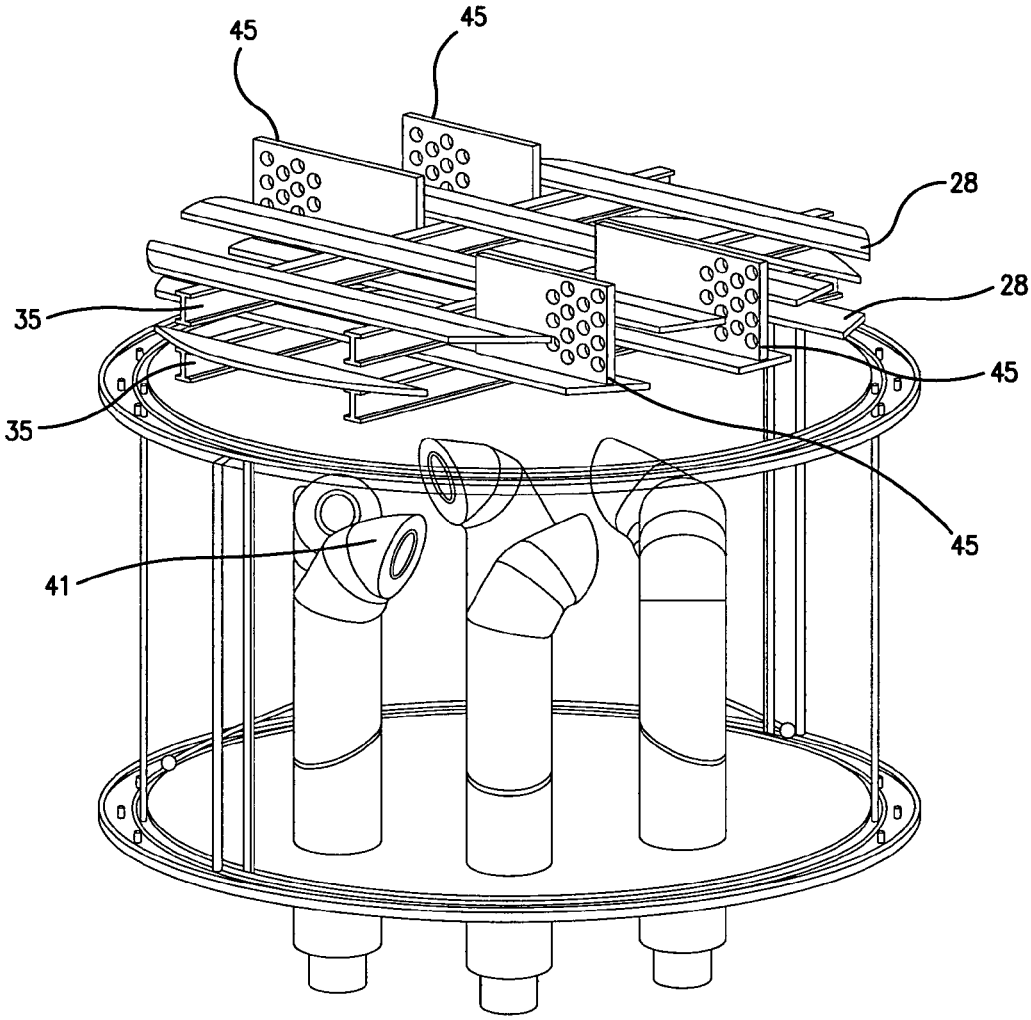
FIG. 3 is a partial view of the shed section of a fluid coker scrubber with baffles in the shed section to reduce gas velocity.

FIG. 3 shows a simplified diagrammatic, partly sectioned view of a fluid coker scrubber section with the baffles installed. The unit in question has six cyclones with gas outlet snouts one of which is generically designated 41, arranged in a circle at even intervals around the central axis of the unit. The scrubber sheds 28 (one designated) are arranged in vertically-spaced levels, supported by beams 35 running transversely to the sheds to the side walls of the vessel to which they are fixed. In most cases, at least five levels of sheds will be provided, typically from five to ten levels. The baffles are in the form of perforated plates 45 fixed vertically towards the outer periphery of the scrubber section, preferably in the outer radial half of the section. The baffles are fixed conveniently on top of selected sheds but may alternatively or in addition be fixed to the support beams. Preferably, the baffles are positioned vertically and are at least partly transverse to the direction of rotational gas flow in the scrubber (i.e. are completely across the direction of rotational gas flow or, alternatively are aligned angularly across the direction of gas flow at their respective locations. This alignment helps to redirect the vapor flow towards the centre of the scrubber, thereby providing a greater cross-sectional area through which the vapor will flow, providing a more uniform velocity distribution. For maximal effectiveness in promoting a uniform gas flow profile, the baffles should be aligned radially although a quasi-radial, quasi-chordal alignment is also effective (for example, in FIG. 3, the baffle on the right hand side of the longer shed is radial or nearly so whereas the baffle on the shorter shed to its left is quasi-radial, quasi-chordal). If it is desired to locate the baffles immediately below the shed section, they may be fixed to the underside of the bottom shed support beams.

Depending on the severity of the fouling problem, the number of vertically-separated levels of baffles may be varied until entrainment-induced fouling is reduced to the desired extent. Often, however, one level of baffles in the shed section or below it will be found sufficient. Similarly, the number of baffles at any one level may be varied according to the extent of fouling encountered or expected in the unit. As shown, four baffles may be used with success in meeting the objective.

The baffles may be made of solid metal plate but it has been found that plates which permit a portion of the gas flow to pass through them are, in fact, better at achieving the desired reduction in rotational velocity: solid (imperforate) plates tend to induce turbulence towards the core region of the scrubber which is undesirable in terms of orderly flow patterns and wash effectiveness. Plates with gas flow apertures formed in them, on the other hand, permit a portion of the gas to flow through the baffle with a reduction in velocity as the coherent wall-bounded jet produced by the snout outlets is disrupted. Thus, the larger vapor jet is broken up into a series of smaller jets which dissipate over a shorter distance than the larger, single jet. In principle, baffles formed of grid or mesh material similar to a small aperture grid might be maximally effective but since the grid or mesh apertures would themselves be subject to fairly rapid fouling, they will not normally be favored over the simpler plate with relatively large apertures in them. The apertures may be in the form of perforations of any shape, e.g. circular or rectangular, or may be provided in the form of slots. An alternative is to use a number of smaller solid plate baffles arrayed close to one another with gas flow passages between the individual plates. The plates may be arranged side-by-side with vertical gas flow passages or on top of one another with horizontal flow passages.

The de-entrainment device may be fabricated of the materials conventional for this service, for example, commercially available grids from such sources as Sulzer and Koch-Glitsch. The de-entrainment device is normally constituted by a grid type packing such as Mellagrid or Nutter grid but structured packings may also be used, for example, Mellapak, Mellapak Plus or Flexipac (Mellagrid, Mellapak and Mellapak Plus are trademarks of Sulzer) or Flexipac (trademark of Koch-Glitsch).

In summary, according to the present invention, baffles in the shed region of the scrubber are effective to break up the jets from the cyclone outlets and reduce the velocity of the vapor flow, resulting in a more uniform velocity profile and temperature distribution across the scrubber which, in turn, results in less heavy oil entrainment and fewer hot spots on the grid with a consequent reduction in fouling.

The invention claimed is:

1. In a fluid coking unit comprising (i) a reactor section, (ii) a superimposed scrubber section, (iii) at least one separator cyclone having its gas outlet communicating with the scrubber section and directing gas flow from the cyclone outlet in a rotational direction in the scrubber section about a central axis of the scrubber section, (iv) a shed section in the scrubber section above the gas outlet of the cyclone, and (v) a de-entrainment section above the shed section, the improvement comprising upstanding, generally vertical, perforated baffle plates aligned at least partly transverse to the rotational flow of gas in the shed section of the scrubber section above the cyclone gas outlets and located in the rotational gas flow path in the radially outer portion of the scrubber section in the region of the scrubber walls to redirect the vapor flow towards the central, axial portion of the scrubber section and with the central, axial portion free of such baffles, to break the vapor flow into a series of smaller jets to improve the uniformity of the gas flow profile in the scrubber by reducing the velocity of the gases from the cyclone gas outlet in the radially outer portion of the scrubber section.

2. A fluid coking unit according to claim 1 in which the de-entrainment section comprises a de-entrainment grid.

3. A fluid coking unit according to claim 1 in which at least some of the baffles are aligned radially with respect to the axis of the scrubber section.

4. A fluid coking unit according to claim 1 in which the perforated baffle plates are fixed on the top of sheds in the shed section.

5. A fluid coking unit according to claim 1 in which the perforated baffle plates are fixed to beams which support the sheds.

6. A fluid coking unit comprising a cylindrical vessel with an upright vertical axis and having (i) a reactor section, (ii) a scrubber section superimposed on the reactor section, (iii) separator cyclones having their inlets in the reactor section, diplegs passing downwardly in the reactor section and gas outlets communicating with the scrubber section and disposed to direct gas flow from the outlets in a rotational direction about the central axis of the scrubber section, (iv) a shed section in the scrubber section and above the gas outlets of the cyclones, (v) a de-entrainment section above the shed section and (vi) upstanding generally vertical, perforated baffle plates above the cyclone gas outlets in the rotational gas flow path in the radially outer portion of the shed section and aligned at least partly transverse to the rotational flow of gas in the shed section to redirect the vapor flow towards the central, axial portion of the scrubber section with the central, axial portion free of such baffles, to break the vapor flow into a series of smaller jets to improve the uniformity of the gas flow profile in the scrubber section by reducing the velocity of the gases from the cyclone gas outlets in the radially outer portion of the shed section in the region of the scrubber section walls.

7. A fluid coking unit according to claim 6 in which the de-entrainment section comprises a de-entrainment grid.

8. A fluid coking unit according to claim 6 in which at least some of the perforated baffle plates are aligned radially with respect to the axis of the scrubber section.

9. A fluid coking unit according to claim 6 in which the scrubber section includes a circulating oil distributor above the shed section for distributing circulating oil over the sheds.

10. A fluid coking unit according to claim 6 in which the scrubber section includes a wash oil distributor above the de-entrainment section for distributing wash oil over the de-entrainment section.

11. A fluid coking unit according to claim 6 in which the perforated baffle plates are fixed on the top of sheds in the shed section.

12. A fluid coking unit according to claim 6 in which the perforated baffle plates are fixed to beams which support the sheds.

* * * * *